United States Patent [19]

Desmond et al.

[11] Patent Number: 4,650,078

[45] Date of Patent: Mar. 17, 1987

[54] CARTON WITH RECLOSABLE POURING OPENING

[75] Inventors: John D. Desmond, Philadelphia, Pa.; Patrick J. O'Brien, Hackensack, N.J.

[73] Assignee: Container Corporation of America, Chicago, Ill.

[21] Appl. No.: 866,319

[22] Filed: May 23, 1986

[51] Int. Cl.[4] ..... B65D 5/54

[52] U.S. Cl. ..... 206/626; 206/621; 229/17 R

[58] Field of Search ..... 229/7 R, 17 R; 206/600, 206/621, 626

[56] References Cited

U.S. PATENT DOCUMENTS

| | | | |
|---|---|---|---|
| 3,133,689 | 5/1964 | Rossi | 229/17 R |
| 4,054,240 | 10/1977 | LaPierre | 229/17 R |
| 4,142,635 | 3/1979 | Capo et al. | 229/17 R |
| 4,317,518 | 3/1982 | Mode | 229/17 R |
| 4,569,443 | 2/1986 | Roccaforte | 229/17 R |

FOREIGN PATENT DOCUMENTS

| | | | |
|---|---|---|---|
| 251411 | 5/1964 | Australia | 229/17 R |
| 393199 | 6/1933 | United Kingdom | 229/17 R |
| 702235 | 1/1954 | United Kingdom | 229/17 R |
| 2045723 | 11/1980 | United Kingdom | 229/17 R |

*Primary Examiner*—William Price
*Assistant Examiner*—Gary E. Elkins
*Attorney, Agent, or Firm*—Richard W. Carpenter

[57] ABSTRACT

A seal end carton, formed from a unitary blank of foldable sheet material and having pairs of major and minor side walls with closure flaps and also having a hinge flap with top and side sections foldably joined to each other with the top section interposed between adjacent top closure flaps and the side section secured to a pouring opening plug cut and in minor side wall of the carton.

1 Claim, 5 Drawing Figures

CARTON WITH RECLOSABLE POURING OPENING

BACKGROUND OF THE INVENTION

1. Field of the Invention

This invention relates generally to folding cartons, and more particularly to a seal end folding carton having a reclosable pouring opening formed in a side wall thereof.

2. Description of the Prior Art

A prior art search directed to the subject matter of this application in the U.S. Patent and Trademark Office revealed the following U.S. Pat. Nos.: 4,308,956; 4,223,789; 4,113,103; 4,019,673; 4,015,768; 3,768,719; 3,563,447; 2,925,948.

None of the prior art patents uncovered in the search discloses a seal end carton having a reclosable pouring opening formed in a minor side panel thereof which is reclosable by means of a side section of hinge flap which is foldably joined to an adjacent side wall of the carton initially, but is thereafter separated therefrom and foldably joined to another section secured to the upper wall of the carton.

SUMMARY OF THE INVENTION

It is an object of the present invention to provide an economical, practical, seal-end type carton having a reclosable pouring opening formed in a side wall thereof.

A more specific object of the invention is the provision, in a carton of the type described, of a unique two-section hinge flap foldably joined initially to a major side wall of the carton and comprising a pair of upper and lower sections one of which is secured to the upper wall of the carton and the other of which is secured to a plug cut in the side wall of the carton which forms the opening, so that the side section can be used to remove the plug from and reinsert the plug into the pouring opening.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
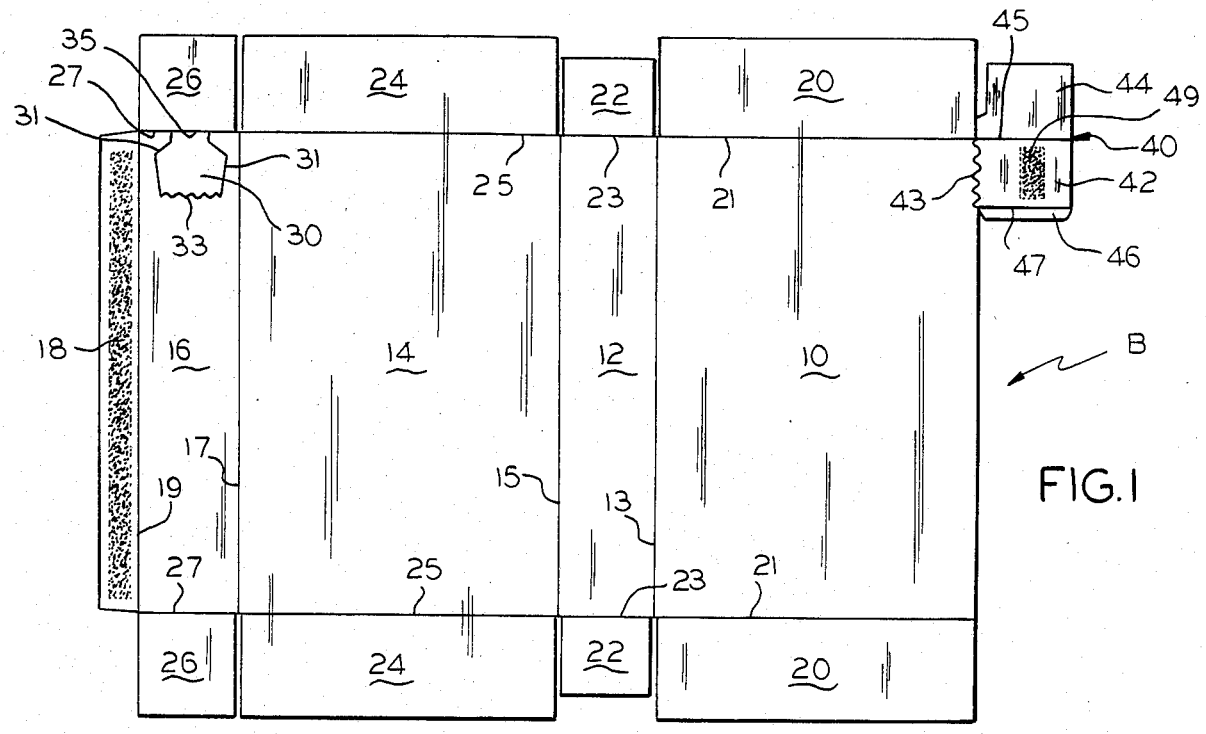
FIG. 1 is a plan view of the inside surface of a blank of foldable sheet material from which the carton illustrated in the other views may be formed.
Figure 3:
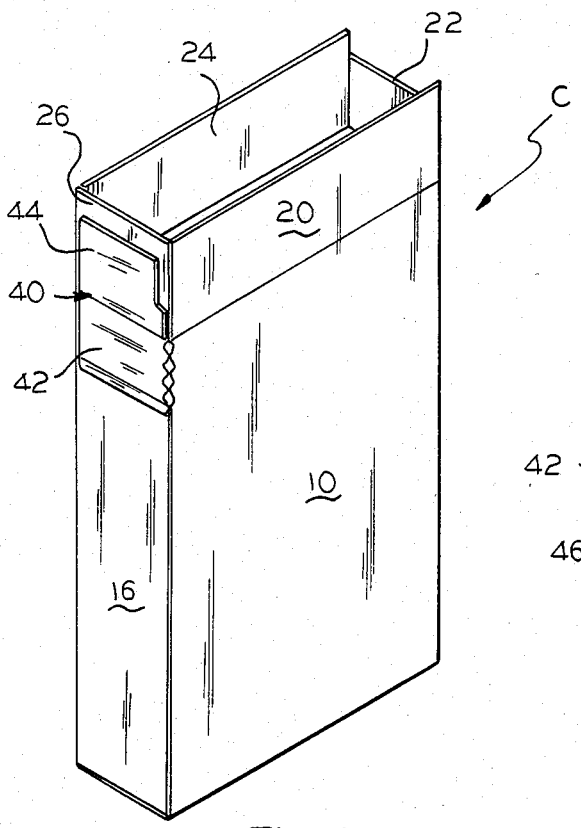
FIG. 3 is a perspective view of a carton embodying features of the invention with the hinge flap shown secured to a minor side wall of the carton but with the upper end of the carton still open.

Referring now to the drawings for a better understanding of the invention, it will be seen that the novel carton indicated generally at C in FIGS. 2-5 of the drawings may be formed from a unitary blank B of foldable sheet material illustrated in FIG. 1 of the drawings.

Still referring to FIG. 1 of the drawings it will be seen that the body of the carton includes a first major side wall panel 10, a first minor side wall panel 12, a second major side wall panel 14, a second minor side wall panel 16, and a glue panel 18, which are foldably joined to each other along fold lines 13, 15, 17 and 19, respectively, to form a tubular structure open at the ends.

Closure of the ends of the carton is accomplished by conventional upper and lower closure flaps 20, 22, 24, and 26, which are foldably joined to the ends of the side wall panels 10, 12, 14, and 16, by fold lines 21, 23, 25, and 27, respectively.

The novelty in the present invention resides in the provision of a pouring opening 37 formed in an upper portion of second minor side wall panel 16 together with the unique means of providing a reclosure for the pouring opening.

Still referring to FIG. 1 it will be seen that pouring opening 37 is initially closed by means of a plug 30 which is cut from material of the second minor side wall panel 16 and which is defined by a pair of side cut lines 31 spaced from each other and connected at the bottom and top by laterally extending lower and upper cut lines 33 and 35, respectively. Actually the cut lines may contain some nicks so that the plug 30 is only attached to the minor side wall panel on a temporary basis and may be readily detached therefrom.

Still referring to FIG. 1 it will be seen that there is provided at the opposite end of the blank B an auxiliary or hinge flap, indicated generally at 40 which includes a pair of side and top sections 42 and 44, respectively, which are foldably joined to each other along a laterally extending fold 45 which is in alignment with the previously mentioned fold line 21.

Hinge flap 40 may also be provided with an additional thumb tab section 46 which is foldably joined to the lower edge of side section 42 along a laterally extending fold line 47. Side section 42 is initially joined to adjacent major side wall panel 10 along a portion of one side edge by a preferably wavy cut line 43 which is also slightly nicked, so that side section 42 of hinge flap can be readily detached from the adjacent major side wall panel 10.

Figure 2:
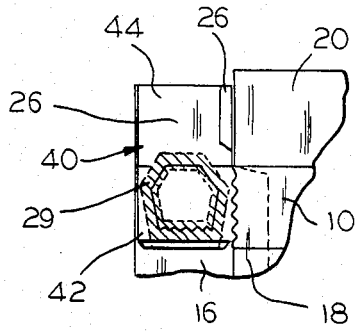
FIG. 2 is a fragmentary perspective view of an upper corner of a carton embodying features of the invention, as seen before the reclosure hinge flap is folded into position thereover.

In forming the carton, side section 42 of hinge flap 40 has a glue application as seen at 49. Side section 42 is folded to overlie the upper portion of minor side wall panel 16 so that the central portion of its inner surface is adhesively secured to the outer surface of the pouring opening plug 30 by means of the adhesive 49. It will be noted, as best seen in FIG. 2, that the area of the upper portion of minor side wall panel 16 surrounding pouring opening plug 30 may be provided with a smooth coating, such as a varnish 29, to prevent it from adhering to certain portions of side section 42 of hinge flap 40 when the side section is folded over the minor side wall panel.

At the same time the side section is secured to the plug, the top section 44 is folded over the outer surface of minor closure flap 26.

At the same time the remaining closure flaps may be folded into overlapped relation and secured to each other in any desired conventional order.

Figure 4:
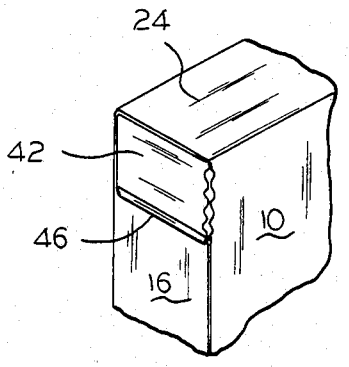
FIG. 4 is a fragmentary view of the upper corner of the carton illustrated in FIG. 3, but with the upper closure flaps shown in closed position.
Figure 5:
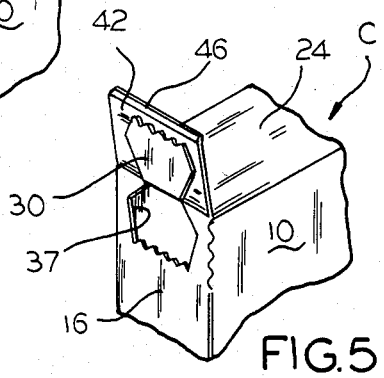
FIG. 5 is a view similar to FIG. 4, but illustrating the manner in which the carton may be opened for dispensing material therefrom.

Thus, once the carton is formed, filled, and secured in closed position, as seen in FIG. 4, to open the carton and dispense material therefrom, hinge flap side section 42 is pulled away from the side wall panel, as shown in FIG. 5. This serves to pull the plug 30, which is attached to the side section 42, out of the minor side wall panel 16 to provide the opening 37. When it is desired to reclose the carton, the side section 42 of the hinge flap is folded downwardly to reinsert the plug 30 into the pouring opening 32.

Thus, it will be appreciated that the invention provides a unique carton of relatively simple design and construction and which is relatively economical to manufacture, but at the same time serves as an excellent reclosable dispensing carton.

What is claimed is:

1. A seal end carton having a reclosable pouring opening, said carton being formed from a unitary blank of foldable sheet material, such as paperboard, and comprising:

(a) a pair of opposed first and second major side wall panels and a pair of first and second minor side wall panels foldably joined to each other to form a tubular structure open at the ends;

(b) upper and lower closure flaps foldably joined to upper and lower ends of each of said side wall panels, with the closure flaps at each end being secured to each other in overlapped relation;

(c) one of said minor side wall panels having adjacent an upper end thereof a plug cut from material of said panel and detachably secured to said panel, for forming a pouring opening therein;

(d) a hinge flap including top and side sections disposed to extend normal to each other;

(e) said top section being interposed between a pair of related upper closure flaps;

(f) said side section being disposed to overlie said one minor side wall panel and having an inner surface central area adhesively attached to an outer surface of said plug and having a peripheral area free from adhesive connection to said one minor side wall panel in the area surrounding said plug;

(g) said side section having a side edge initially, detachably, hingedly connected to a related upper portion of a side edge of a major side wall panel adjacent said one minor side wall panel and having an upper edge foldably joined to an outer edge of said top section, so that said side section and attached plug can be pulled away from said one minor side wall panel to detach said plug from said one minor side wall panel and form a pouring opening therein, leaving said side section foldably joined to said top section, so that it can thereafter be folded toward said one minor side wall panel to reclose said pouring opening with said plug.

* * * * *